US009272387B2

(12) United States Patent
Meyer et al.

(10) Patent No.: US 9,272,387 B2
(45) Date of Patent: Mar. 1, 2016

(54) CARRIER HEAD WITH SHIMS

(75) Inventors: Stacy Meyer, San Jose, CA (US); Young J. Paik, Campbell, CA (US); Christopher R. Mahon, San Bruno, CA (US)

(73) Assignee: Applied Materials, Inc., Santa Clara, CA (US)

( * ) Notice: Subject to any disclaimer, the term of this patent is extended or adjusted under 35 U.S.C. 154(b) by 814 days.

(21) Appl. No.: 13/445,316

(22) Filed: Apr. 12, 2012

(65) Prior Publication Data

US 2012/0264360 A1 Oct. 18, 2012

Related U.S. Application Data

(60) Provisional application No. 61/475,167, filed on Apr. 13, 2011.

(51) Int. Cl.
*B24B 37/32* (2012.01)

(52) U.S. Cl.
CPC ..... *B24B 37/32* (2013.01); *Y10T 29/49826* (2015.01)

(58) Field of Classification Search
CPC ..... B24B 37/32; B24B 49/00
See application file for complete search history.

(56) References Cited

U.S. PATENT DOCUMENTS

| | | | | |
|---|---|---|---|---|
| 6,089,961 | A * | 7/2000 | Cesna et al. | 451/285 |
| 6,206,768 | B1 * | 3/2001 | Quek | 451/287 |
| 6,602,114 | B1 * | 8/2003 | Wang et al. | 451/41 |
| 6,866,571 | B1 * | 3/2005 | Held | 451/390 |
| 2003/0148718 | A1 | 8/2003 | Yun et al. | |
| 2005/0164617 | A1 | 7/2005 | Spiegel | |
| 2006/0099893 | A1 * | 5/2006 | Masunaga et al. | 451/287 |
| 2007/0243796 | A1 * | 10/2007 | Torii | 451/5 |

FOREIGN PATENT DOCUMENTS

| | | |
|---|---|---|
| WO | WO01/74536 | 10/2001 |
| WO | WO01/89763 | 11/2001 |

OTHER PUBLICATIONS

International Search Report/Written Opinion for corresponding application PCT/US2012/033350 dated Oct. 24, 2012.

* cited by examiner

*Primary Examiner* — Lee D Wilson
*Assistant Examiner* — Tyrone V Hall, Jr.
(74) *Attorney, Agent, or Firm* — Fish & Richardson P.C.

(57) ABSTRACT

A carrier head includes a base, a substrate mounting surface, a retaining ring secured to the base, and a plurality of stacked shims located between the base and the retaining ring. The retaining ring has a bottom surface for contacting a polishing pad during polishing.

12 Claims, 1 Drawing Sheet

CARRIER HEAD WITH SHIMS

CROSS-REFERENCE TO RELATED APPLICATIONS

This application claims priority to U.S. application Ser. No. 61/475,167, filed on Apr. 13, 2011, which is incorporated by reference.

TECHNICAL FIELD

The present disclosure relates to a carrier head for chemical mechanical polishing.

BACKGROUND

Integrated circuits are typically formed on substrates, particularly silicon wafers, by the sequential deposition of conductive, semiconductive or insulative layers. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad.

The substrate is typically retained below the carrier head by a retaining ring. However, because the retaining ring contacts the polishing pad, the retaining ring tends to wear away, and is occasionally replaced.

SUMMARY

Retaining rings can be expensive, and as noted above, need to be periodically replaced when worn. One technique to extend the lifetime of a retaining ring is to insert a shim between the retaining ring and the base of the carrier head. This can move the bottom surface of the retaining ring into the appropriate position. In fact, multiple shims could be used to further extend the lifetime of the retaining ring. Material composition of the shim can be important to provide the proper mechanical interaction of the retaining ring with the polishing pad.

In one aspect, a carrier head includes a base, a substrate mounting surface, a retaining ring secured to the base, and a plurality of stacked shims located between the base and the retaining ring. The retaining ring has a bottom surface for contacting a polishing pad during polishing.

Implementations can include one or more of the following features. The plurality of stacked shims may include a first shim and a second shim, and the first shim may be thicker than the second shim. The first shim may be closer to the retaining ring than the second shim. The first shim may be about 90 mils thick, and the second shim may be about 30 mils thick. A plurality of screws may secure the retaining ring to the base, and the plurality of screws may pass through the plurality of stacked shims. A plurality of slurry-transport channels may be formed on the bottom surface of the retaining ring. The retaining ring may include a lower portion of a first material having the bottom surface and an upper portion of a second material that is more rigid than the lower portion. The first material may be PPS and the second material may be stainless steel. The shim may be stainless steel. A lower surface of a flexible membrane may provide the substrate mounting surface, and an edge portion of the flexible membrane may be clamped between an uppermost shim of the plurality of stacked shims and the base.

In another aspect, a method of using a retaining ring includes securing the retaining ring to a base in a carrier head without a shim between the base and the retaining ring, polishing a first plurality of substrates with the carrier head with a lower surface of the retaining ring contacting a polishing surface, removing the retaining ring from the carrier head after the lower surface of the ring has been worn by a first amount, re-securing the retaining ring to the carrier head with a first shim between the base and the retaining ring to compensate for the first amount of wear, polishing a second plurality of substrates with the carrier head, removing the retaining ring from the carrier head after the lower surface of the ring has been worn by a second amount, and re-securing the retaining ring to the carrier head with the first shim and a second shim between the base and the retaining ring to compensate for the second amount of wear.

Implementations can include one or more of the following features. The first amount may be greater than the second amount. A thickness of the first shim may be greater than a thickness of the second shim. The first shim may be about 90 mils thick, and the second shim may be about 30 mils thick. The retaining ring may be secured to the base with a plurality of screws that pass through the plurality of stacked shims. Slurry may be transported through a plurality of slurry-transport channels formed on the bottom surface of the retaining ring. The first shim may have a first thickness about equal to the first amount and the second shim may have a second thickness about equal to the second amount.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

During a polishing operation, one or more substrates can be polished by a chemical mechanical polishing (CMP) apparatus that includes a carrier head 100. A description of a CMP apparatus can be found in U.S. Pat. No. 5,738,574.

Figure 1:
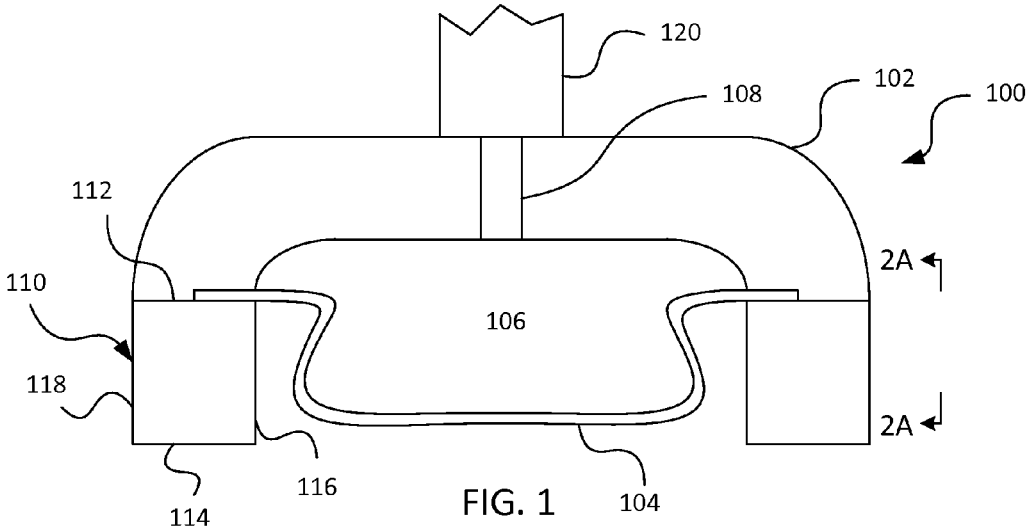
FIG. 1 is a schematic cross-sectional view of a chemical mechanical polishing apparatus.

Referring to FIG. 1, an exemplary simplified carrier head 100 includes a housing 102, a flexible membrane 104 that provides a mounting surface for the substrate, a pressurizable chamber 106 between the membrane 104 and the housing 102, and a retaining ring 110 secured near the edge of the housing 102 to hold the substrate below membrane 104. A drive shaft 120 can be provided to rotate and/or translate the carrier head across a polishing pad. A pump (not shown) may be fluidly connected to the chamber 106 though a passage 108 in the housing to control the pressure in the chamber 106 and thus the downward pressure of the flexible membrane 104 on the substrate.

Figure 2A:
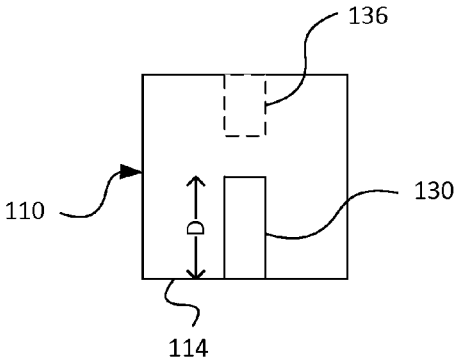
FIG. 2A is a side view of a retaining ring.
Figure 2B:
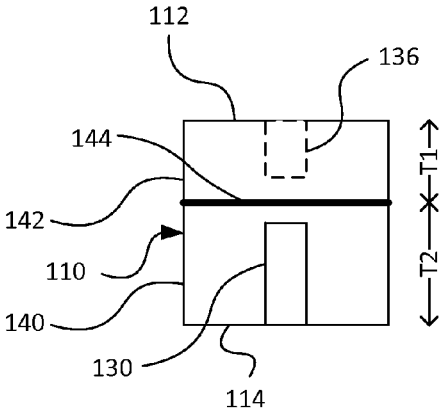
FIG. 2B is a side view of another implementation of a retaining ring.

The retaining ring 110 may be a generally annular ring secured at the outer edge of the base 102, e.g., by screws or bolts 136 (only one is shown in FIGS. 2A-2B) that extend through aligned passages in the base 102 into the upper surface 112 of the retaining ring 110. In some implementations, the drive shaft 120 can be raised and lowered to control the pressure of a bottom surface 114 of the retaining ring 110 on a polishing pad. Alternatively, the retaining ring 110 can be movable relative to the base 120 and the carrier head 100 can include an internal chamber which can be pressurized to control a downward pressure on the retaining ring, e.g., as described in U.S. Pat. No. 6,183,354 or 7,575,504, which are incorporated by reference.

An inner surface 116 of retaining ring 110 defines, in conjunction with the lower surface of the flexible membrane 104, a substrate receiving recess. The retaining ring 110 prevents the substrate from escaping the substrate receiving recess.

The bottom surface 114 of the retaining ring 110 can be substantially flat, or as shown in FIGS. 2A and 2B, in some implementations it may have a plurality of channels 130 that extend from the inner surface 116 to the outer surface 118 of the retaining ring to facilitate the transport of slurry from outside the retaining ring to the substrate (only one channel is shown in the side view of FIGS. 2A and 2B). The channels 130 may have a starting depth D of about 240 mils.

Referring to FIG. 2B, in some implementations, the retaining ring 110 includes multiple sections, including an annular lower portion 140 having the bottom surface 114 that may contact the polishing pad, and an annular upper portion 142 connected to base 104 that is more rigid than the lower portion 140. Lower portion 140 may be bonded to upper portion 142 with an adhesive layer 144. The lower portion 140 can be a plastic, e.g., polyphenol sulfide (PPS), whereas the upper portion 142 of retaining ring 110 is formed of a rigid material, such as a metal, e.g., stainless steel. The upper portion 140 can have a thickness T1 of 410 mils, and the lower portion can have a starting thickness T2 of 340 mils.

Figure 3:
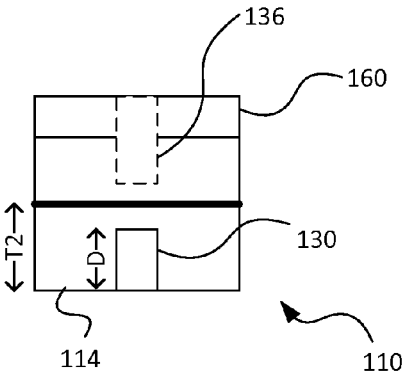
FIG. 3 is a side view of a retaining ring and a shim.
Figure 4:
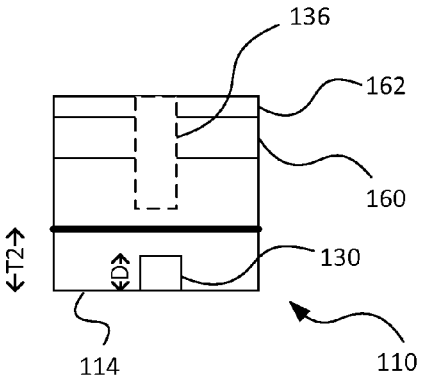
FIG. 4 is a side view of a retaining ring and multiple shims.

Referring to FIG. 3, after a portion of the retaining ring has been worn away, an annular shim 160 can be placed between the retaining ring 110 and the base 104 to form part of the carrier head structure, with screws 136 extending through apertures in the shim 160. The thickness of the shim 160 can be the same as the amount by which the retaining ring has worn away. The shim can be a right angular cylindrical part, and can have the same inner diameter and outer diameter as the top surface 112 of the retaining ring. The shim can be a relatively rigid material, e.g., stainless steel. If the retaining ring has an upper portion 140 and a lower portion 142 as shown in FIG. 2B, then the shim can be the same material as the upper portion 142.

The retaining ring can be a high precision part, and once the retaining ring has been worn away by a certain amount, e.g., 40 mils, the carrier head may not function properly. For example, the lower surface 114 of the retaining ring might not contact the polishing pad with the appropriate pressure during polishing. However, the shim 160 increases the distance between the base 104 and the lower surface 114 of the retaining ring 110 to maintain proper function of the carrier head. This permits the user to reuse the retaining ring 110 rather than purchase a new retaining ring. The channels 130 may need to be deeper to accommodate the increased use of the retaining ring.

In some implementations, the shim 160 can be about 90 mils thick, and can be inserted after about 90 mils of the retaining ring have been worn away, e.g., when the lower portion 140 has a thickness T2 of about 250 mils and the grooves have a depth D of about 150 mils.

The refurbishment process can be repeated multiple times. In this case, a second shim 162 can be placed between the retaining ring 110 and the base 104. The thickness of the second shim 162 can be the same as the amount by which the retaining ring has worn away after insertion of the first shim 160. The second shim 162 can be placed above or below the first shim 160. The second shim 162 can be thinner than the first shim 160. The second shim 162 can be formed of the same material as the first shim 160.

In some implementations, the second shim 162 can be about 30 mils thick, and can be inserted after about another 30 mils of the retaining ring have been worn away, e.g., when the lower portion 140 has a thickness T2 of 220 mils and the grooves have a depth D of about 120 mils. It can be possible to polish with such a retaining ring until the grooves have a depth of about 30 mils and the lower portion has a thickness T2 of about 130 mils.

A number of implementations have been described. Nevertheless, it will be understood that various modifications may be made. Accordingly, other implementations are within the scope of the following claims.

What is claimed is:

1. A carrier head, comprising:

a base;

a substrate mounting surface;

a retaining ring secured to the base, the retaining ring having a bottom surface for contacting a polishing pad during polishing and a top surface for contacting the base, the top surface being substantially flat from an inner diameter of the retaining ring to an outer diameter of the retaining ring; and a plurality of stacked shims located between the base and the retaining ring, wherein the plurality of stacked shims includes a first shim and a second shim, and the first shim is thicker than the second shim, wherein each shim of the plurality of stacked shims has a same inner diameter and outer diameter as the retaining ring.

2. The carrier head of claim 1, wherein the first shim is closer to the retaining ring than the second shim.

3. The carrier head of claim 1, wherein the first shim is about 90 mils thick, and the second shim is about 30 mils thick.

4. The carrier head of claim 1, further comprising a plurality of screws securing the retaining ring to the base, the plurality of screws passing through the plurality of stacked shims.

5. The carrier head of claim 1, further comprising a plurality of slurry-transport channels formed on the bottom surface of the retaining ring.

6. The carrier head of claim 1, wherein the retaining ring comprises a lower portion of a first material having the bottom surface and an upper portion of a second material that is more rigid than the lower portion.

7. The carrier head of claim 6, wherein the first material is PPS and the second material is stainless steel.

8. The carrier head of claim 7, wherein each shim is stainless steel.

9. The carrier head of claim 6, wherein each shim of the plurality of stacked shims is the second material.

10. The carrier head of claim 1, further comprising a flexible membrane, a lower surface of the flexible membrane providing the substrate mounting surface, and wherein an edge portion of the flexible membrane is clamped between an uppermost shim of the plurality of stacked shims and the base.

11. The carrier head of claim 1, wherein each shim of the plurality of stacked shims is right angular cylindrical part.

12. The carrier head of claim 1, wherein each shim of the plurality of stacked shims is formed of the same material.

* * * * *